United States Patent [19]

Keefer

[11] Patent Number: 4,831,224

[45] Date of Patent: May 16, 1989

[54] PACKAGE OF MATERIAL FOR MICROWAVE HEATING INCLUDING CONTAINER WITH STEPPED STRUCTURE

[75] Inventor: Richard M. Keefer, Peterborough, Canada

[73] Assignee: Alcan International Limited, Montreal, Canada

[21] Appl. No.: 44,588

[22] Filed: Apr. 30, 1987

[30] Foreign Application Priority Data

May 9, 1986 [CA] Canada ..... 508812

[51] Int. Cl.[4] ..... H05B 6/80

[52] U.S. Cl. ..... 219/10.55 E; 219/10.55 F; 426/107; 426/243; 99/DIG. 14

[58] Field of Search ..... 219/10.55 E, 10.55 F, 219/10.55 M, 10.55 R, 10.55 D; 426/107, 241, 243, 234; 99/DIG. 14, 451; 126/390

[56] References Cited

U.S. PATENT DOCUMENTS

| | | | |
|---|---|---|---|
| 2,856,497 | 10/1958 | Rudenberg | 219/10.55 E |
| 3,934,106 | 1/1976 | MacMaster et al. | 219/10.55 E |
| 3,946,187 | 3/1976 | MacMaster et al. | 219/10.55 E |
| 4,286,136 | 8/1981 | Mason, Jr. | 219/10.55 E |
| 4,416,906 | 11/1983 | Watkins | 219/10.55 M |
| 4,689,458 | 8/1987 | Levendusky et al. | 219/10.55 E |

*Primary Examiner*—Philip H. Leung

*Attorney, Agent, or Firm*—Cooper & Dunham

[57] ABSTRACT

A container for containing a material to be heated in a microwave oven, having at least one stepped structure protruding into or out of the container from a surface thereof, this structure including a side wall or side walls that define boundary conditions that generate a microwave field pattern within the container having a higher order than that of the fundamental mode of the container.

15 Claims, 6 Drawing Sheets

1224

PACKAGE OF MATERIAL FOR MICROWAVE HEATING INCLUDING CONTAINER WITH STEPPED STRUCTURE

The present invention relates to containers which hold material for heating or cooking, primarily in a microwave oven. Although the material to be heated or cooked will primarily be a foodstuff, the present invention is not limited to the heating or cooking of foodstuffs. More particularly, containers of the present invention provide a more even energy distribution throughout the entire volume of the material being heated. As a result, this material heats to a more even temperature throughout its volume. Other embodiments may be used to tailor the temperature at certain areas within the material to provide a desired, but not necessarily more even energy distribution.

The present invention can be utilised in both metallic (reflective) containers, and in microwave-transparent and semi-microwave-transparent (non-reflective) containers.

Conventional containers have smooth bottoms and sidewalls. They act primarily as resonant devices and as such, promote the propagation of a fundamental resonant mode of microwave energy. Microwave energy in the oven is coupled into the container holding the material via, for example, the top of the container, and propagates within the container. The energy of the microwaves is given up in the lossy material or foodstuff and converted to heat energy which heats or cooks the material or foodstuff. By and large the boundary conditions of the container constrain the microwave energy to a fundamental mode. However, other modes may exist within the container but at amplitudes which contain very little energy. In typical containers, thermal imaging has revealed that the propagation of the microwave energy in the corresponding fundamental modes produces localised areas of high energy and therefore high heating while at the same time producing areas of low energy and therefore low heating. In most containers, high heating is experienced in an annulus near the perimeter of the container, with low energy heating in the central region. Such a pattern would strongly indicate fundamental mode propagation.

These problems may be alleviated by generating or enhancing higher order modes of microwave energy within the container. One way of achieving this is described in our co-pending European patent application 0206811, the contents of which are incorporated herein by reference. The present invention is essentially concerned with alternative methods of achieving the generation or enhancement of the higher order modes.

According to the present invention there is provided a container for containing a material to be heated in a microwave oven, said container including a sidewall or sidewalls and a bottom and being formed with means for generating a microwave field pattern within the container having a higher order than that of the fundamental mode of the container, said container being characterised in that said higher order mode generating means comprises at least one stepped structure protruding into or out of said container from a surface thereof, said structure including a sidewall or sidewalls that define boundary conditions that generate said higher order mode of microwave energy. Preferably, the container takes the form of an open-topped tray for carrying said material, which tray is preferably provided with a lid which covers said tray to form a closed cavity therewith. In a multi-compartment container, such as is used for heating several different foodstuffs simultaneously, the term "container" as used herein should be interpreted as meaning an individual compartment of that container. If, as is commonly the case, a single lid covers all compartments, then "lid" as used above means that portion of the lid which covers the compartment in question.

The container may be made primarily from metallic material, such as aluminium, or primarily from non-metallic material such as one of the various dielectric plastic materials currently being used to fabricate microwave containers, or a combination of both.

The present invention forces higher order modes of microwave energy to simultaneously exist within the container. Higher order modes of microwave energy have different energy patterns. Since the present invention causes at least one higher order mode of microwave energy to exist in conjunction with the fundamental modes and since the total microwave energy propagating within the container is divided between the total number of modes, it can be seen that a more even heating can be obtained. As a result, a container which forces multi-mode propagation yields a foodstuff which is more evenly cooked in a microwave oven. The term multi-mode in this application means a fundamental mode and at least one higher order mode. If because of the container geometry or as a result of the nature of the material being heated, higher order modes already exist within the container, the present invention can amplify the energy content of these modes.

The present invention accomplishes this multi-mode generation or amplification by introducing a structure or structures onto a surface of the container, which structure or structures act to change the boundary conditions of the container so that higher order modes of microwave energy are caused to propagate. The structure or structures may be formed on any one or more of the surfaces of the container, as circumstances dictate, but preferably they are formed on the bottom surface only.

In considering the heating effect of higher modes which may or may not exist within the container, it is necessary to notionally subdivide the container into cells, the number and arrangement of these cells depending upon the particular higher order mode under consideration. Each of these cells behaves, from the point of view of microwave power distribution, as if it were itself a container and therefore exhibits a power distribution which is high around the edges of the cell, but low in the centre. Because of the physically small size of these cells, heat exchange between adjacent cells during cooking is improved and more even heating of the material results. However in the normal container, i.e. unmodified by the present invention, these higher order modes are either not present at all or, if they are present, are not of sufficient strength to significantly heat the food. Thus the primary heating effect is due to the fundamental mode of the container i.e. a central cold area.

Recognising these problems, what the present invention seeks to do, in essence, is to heat this cold area by introducing heating energy into the cold area. This can be achieved in two ways (1) by redistributing the microwave field pattern within the container by enhancing higher order modes which naturally exist anyway within the container due to the boundary conditions set by the physical geometry of the container, but not at an energy level sufficient to have a substantial heating effect or, where such naturally higher order modes do not exist at all (due to the gometry of the container), to generate such natural modes.

(2) to superimpose or "force" onto the normal field pattern—which, as has been said, is primarily in the fundamental mode—a further higher order field pattern whose characteristics owe nothing to the geometry of the container and whose energy is directed towards the geometric centre of the container in the horizontal plane which is the area where the heating needs to be enhanced.

In both the above cases the net result is the same; the container can be notionally considered as having been split into several smaller areas each of which has a heating pattern similar to that of the fundamental mode, as described above. However, because the areas are now physically smaller, normal thermal convection currents within the food have sufficient time, during the relatively short microwave cooking period, to evenly redistribute the heat and thus avoid cold areas. In practice, under certain conditions higher order mode heating may take place due to both of the above mechanisms simultaneously.

In the present invention, the higher order modes are generated or enhanced by a protruding stepped structure. For example, a metallic step or wall forces the voltage pattern of a mode to be zero or short-circuited at that step or wall. This boundary condition forces certain lower order modes including, for example, the fundamental mode to be in what is known as cutoff and allows only higher order modes to exist which naturally have a zero voltage point at the location of the step or wall. In other words, at a given fundamental frequency, the equations defining one or more higher order modes have solutions for the boundary condition constraint of the physical location of the step or wall.

By employing various structures on the bottom of a container, higher order modes propagate. Microwave energy therefore exists in these higher order modes and heating occurs in the material or foodstuff in the pattern of the higher order mode. The overall effect can be more even heating of the foodstuff.

The boundary conditions in a metallic container are very strongly and well defined. However, with a microwave-transparent container, the interface between surrounding free-space and a contained material or foodstuff having a high dielectric constant and losses gives rise to analogous theory and similar practical solutions. Placing raised structures which are microwave-transparent on the bottom of the microwave-transparent container provides walls and steps in the interface between the contained material and the surrounding free-space which cause higher order modes to propagate within the material, resulting in a more even heating of the foodstuff.

There appears to be a relationship between the fill depth of the material being heated and the height of the structure placed on the bottom of the container. It has been found that a substantial increase in temperature can be obtained in the region directly over the step horizontal surface when the ratio of the step height to fill depth is from 0.3 to 0.7. Other tailored effects can be obtained by choosing ratios outside this range.

Embodiments of the present invention will be described in detail with the aid of the accompanying drawings, in which.

Figure 1:
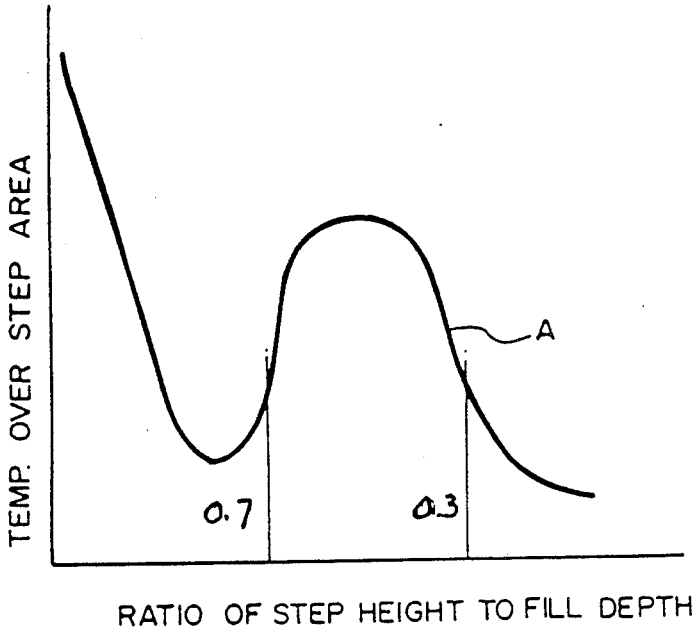
FIG. 1 is a diagram showing the relationship between fill depth and step height of an embodiment according to the present invention.

FIG. 1 curve A illustrates the relationship between the fill depth of the material to be heated in a container and the height of the step affixed to the bottom of the container and the temperature in the material in the area over the step. Elevations in temperature in the area over the step occur when the ratio of the step height to fill depth ranges from 0.3 to 0.7. For specific tailored applications the range from about 0.2 to 0.3 can be employed if it is desired to reduce the temperature in the material over the area of the step.

Figure 2:
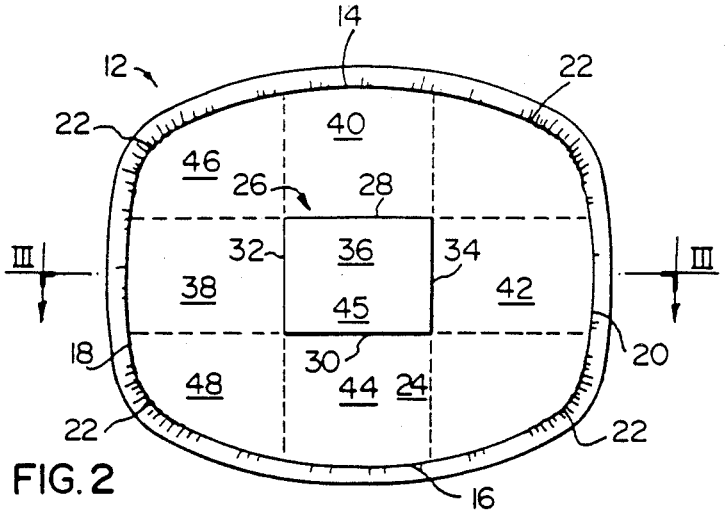
FIG. 2 is a top plan view of a semi-elliptical shaped container employing the present invention.
Figure 3:
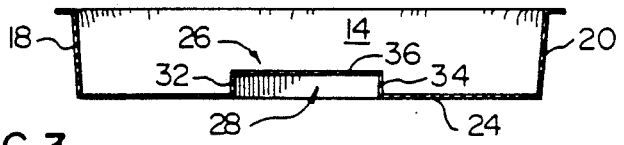
FIG. 3 is a sectional view of the container of FIG. 2 taken along line III—III of FIG. 2.

FIGS. 2 and 3 show a tray or pan 12 having outwardly curved sidewalls 14,16,18 and 20 and rounded corners 22, and a generally planar bottom 24. A rectangular stepped structure 26 is centrally located on the bottom 24. This structure has sidewalls 28, 30,32 and 34 and a top surface 36. The fundamental microwave mode will propagate in the pan 12 by virtue of the boundary conditions determined by sidewalls 14, 16,18 and 20. A higher order mode of microwave energy will propagate in the pan as a result of the boundary conditions defined by sidewalls 14,16,18,20 of the pan and the sidewalls 28,30,32,34 of the structure 26. The higher order mode generates a microwave field pattern such as to notionally divide the pan into separate areas 38,40,42,44 in the horizontal plane.

The microwave energy entering container 12 will be divided between the different modes simultaneously propagating within container 12. Consequently, the heating in the central (non-peripheral) region of the container will be enhanced relative to that experienced in a container not provided with the structure 26, and a much more even distribution of the microwave energy and therefore of the heat energy is achieved.

The base of the container 12 is typically 13.5 cm long and 10.5 cm wide. The structure 36, for a pan of those dimensions is typically 4.5×3.5 cms and is 1 cm high. The height of the step is set to be approximately one-half of the total fill depth of the material being heated, but can advantageously range from 0.3 to 0.7.

The term "fill depth" relates to the average depth of the contents above the main plane of the bottom of the container without regard to the step. In the case of a container that is designed as a reusable utensil and in certain other circumstances, a specific fill depth below the edge of the container may be designated.

A similar embodiment (not shown) arranged a similar stepped structure within a generally rectangular container, using both a metallic container and a plastic (microwave transparent) container. Evidence of higher order mode existence was observed in both instances. Such existence was determined by thermal micrographs.

Figure 4:
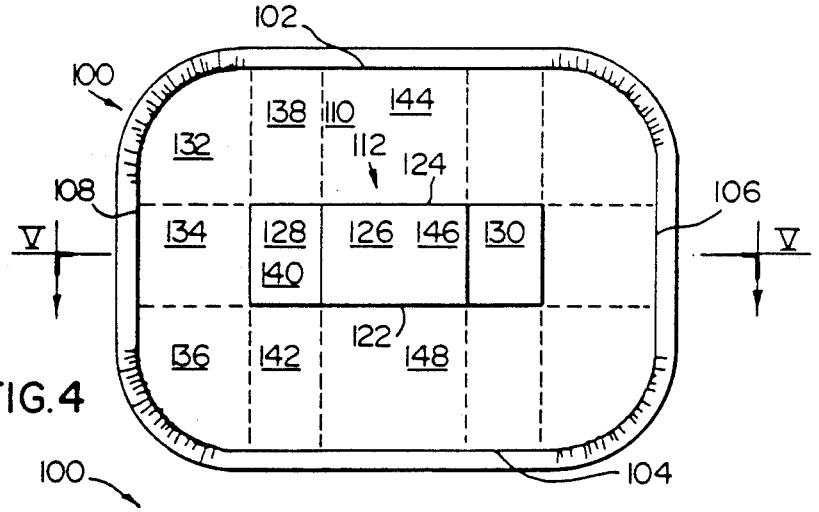
FIG. 4 is a top plan view of a rectangular container employing the present invention.
Figure 5:
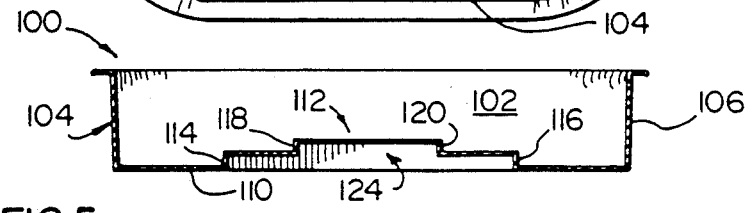
FIG. 5 is a sectional view of the container of FIG. 4 taken along line V—V of FIG. 4.

A doubled step structure is shown in FIGS. 4 and 5. In this instance, a rectangular pan 100 includes sidewalls 102,104,106 and 108. Pan 100 also includes a bottom surface 110. Centrally located on bottom surface 110 is double stepped structure 112.

Doubled stepped structure 112 is composed of primary sidewalls 114 and 116. Secondary sidewalls 118 and 120 define, along with walls 122 and 124 a generally rectangular mesa 126. Lower steps 128 and 130 are defined by primary sidewalls 114,116,122 and 124. The structure 112, as a result, takes on a rising and falling stair step appearance. The step structure 112 located within pan 100 creates, for example, regions 132,134,136,138,140,142,144,146 and 148.

The boundary conditions imposed by the walls 102,104,106 and 108 of the container and the walls 114,116,118,120,122 and 124 of the structure 112 cause a multiplicity of higher order modes to be generated within the container, and result in a heating pattern derived from the notional subdivision of the container into the areas indicated by the dotted lines, as well as by the structure 112 itself. Examples of such regions are indicated under references 132,134,136,138, 140,142,144,146 and 148.

This embodiment employs a rectangular container 100 with bottom dimensions 9×13.5 cm. The structure 112 has a lower structure 9×3×0.5 cm and an upper structure 4.5×3 cm, at a distance of 1 cm from the base of the container.

Figure 6:
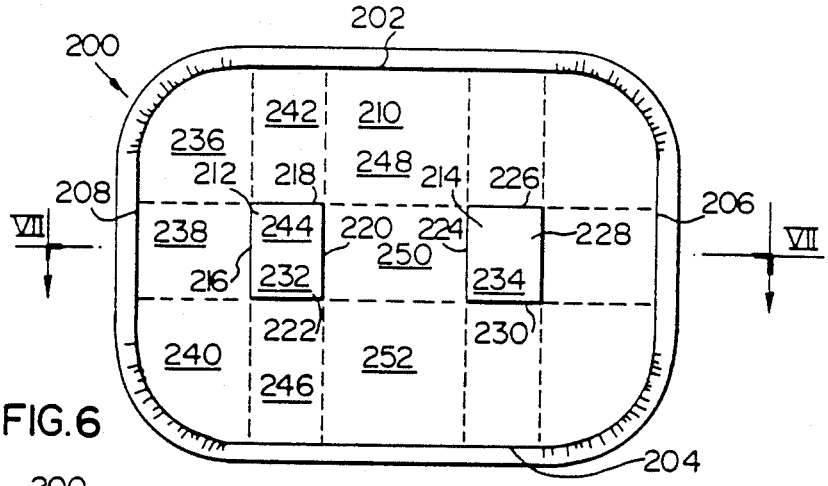
FIG. 6 is a top plan view of a rectangular container employing another embodiment of the present invention.
Figure 7:
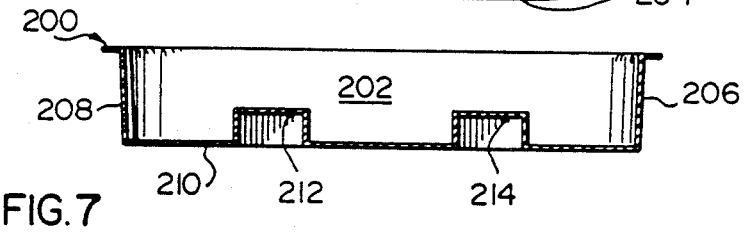
FIG. 7 is a sectional view of the container of FIG. 6 taken along line VII—VII of FIG. 6.

FIGS. 6 and 7 show a rectangular container having two stepped structures located therein. FIGS. 6 and 7 show container 200 having sidewalls 202,204,206 and 208 along with bottom 210. Two higher order mode generating structures 212 and 214 are located symmetrically on the bottom 210 of pan 200. These higher order mode structures include sidewalls 216,218,220 and 222 for structure 212 and sidewalls 224,226,228 and 230 for structure 214. Structure 212 includes a top surface 232 and structure 214 includes a top surface 234.

The two higher order mode structures break up the interior of the container 200 into various regions indicated by the dotted lines. Typical regions are shown in FIG. 6 of the drawings by numerals 236,238, 240,242,244,246,248,250 and 252. Other regions also exist; however, for the sake of this description a detailed discussion of these regions is not necessary.

Sidewall 208 in conjunction with sidewall 216 of higher order mode generating structure 212 define boundary conditions which allow a higher order mode to propagate in region 238. Similar higher order modes will propagate in regions 242,244 and 246. A higher order mode will propagate in region 250 by virtue of the boundary conditions defined by sidewalls 220 and 224 of higher order mode generating structures 212 and 214 respectively.

Other higher order modes will exist within the container. One such higher order mode will propagate in a combination of regions 236,238 and 240 by virtue of the boundary conditions set down by sidewalls 202, 204,206 and sidewall 216 of multi-mode structure 212.

As can be seen from FIGS. 6 and 7, many higher order modes propagate within container 200 in various regions of that container. Each one of these higher order modes propagates due to boundary conditions set up by either the sidewalls of higher order mode generating structures 212 and 214 in conjunction with sidewalls 202,204,206 and 208 of the container itself.

This embodiment tailors the temperature distribution in the material being heated so as to elevate the temperature over the areas of the structures 212 and 214.

Each higher order mode structure 212 and 214 is 2.5×3×1 cm. Structures 212 and 214 are spaced 4.5 cm apart.

Figure 8:
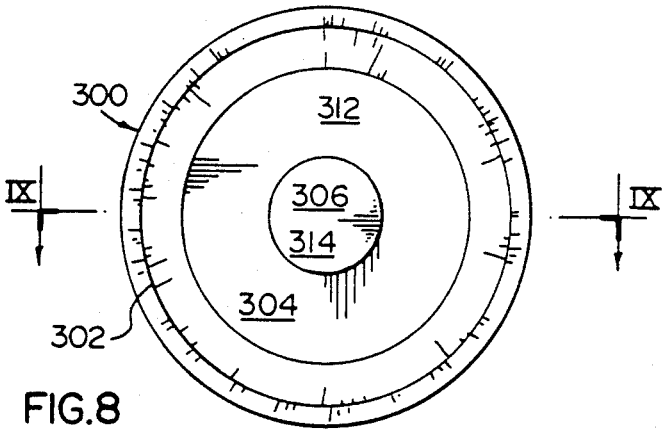
FIG. 8 is a top plan view of a circular container containing the present invention.
Figure 9:
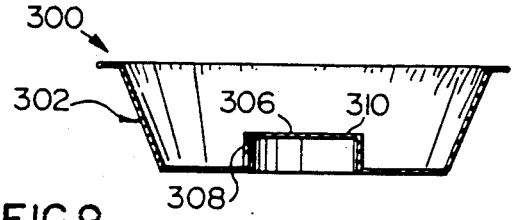
FIG. 9 is a sectional view of the container of FIG. 8 taken along line IX—IX of FIG. 8.

FIGS. 8 and 9 show a circular embodiment of the present invention used in conjunction with a circular pan 300. Circular pan 300 is comprised of a tapered cylindrical sidewall 302 and a bottom 304. A higher order mode generating structure 306 is centrally located on the bottom 304 of pan 300. The higher order mode generating structure 306 includes a cylindrical sidewall 308 and a top surface 310. The boundary conditions defined by sidewall 302 of the pan 300 and 308 of the higher order mode generating structure 306 create two regions 312 and 314 within the container 300.

The fundamental mode propagates within the pan 300 by virtue of the boundary conditions of the sidewall 302 of the pan 300. A first higher order mode propagates in the annular region 312 by virtue of the boundary conditions determined by the sidewall 302 of the container 300 and the sidewall 308 of the higher order mode generating structure 306. A second higher order mode exists in area 314 by virtue of the boundary conditions defined by the sidewalls 308. As a result, at least two higher order modes simultaneously propagate within the cylindrical container 300 in addition to the fundamental mode. Higher order mode generating structure 306 therefore produces a more even distribution of the microwave energy within the container 300 and, as a result, provides a more even heating of the material which would be contained therein.

In this example, pan 300 is 10 cm in diameter and structure 306 is 4 cm in diameter by 1 cm high. Once again the height of the structure 306 is determined by the fill depth of the material to be heated.

Figure 10:
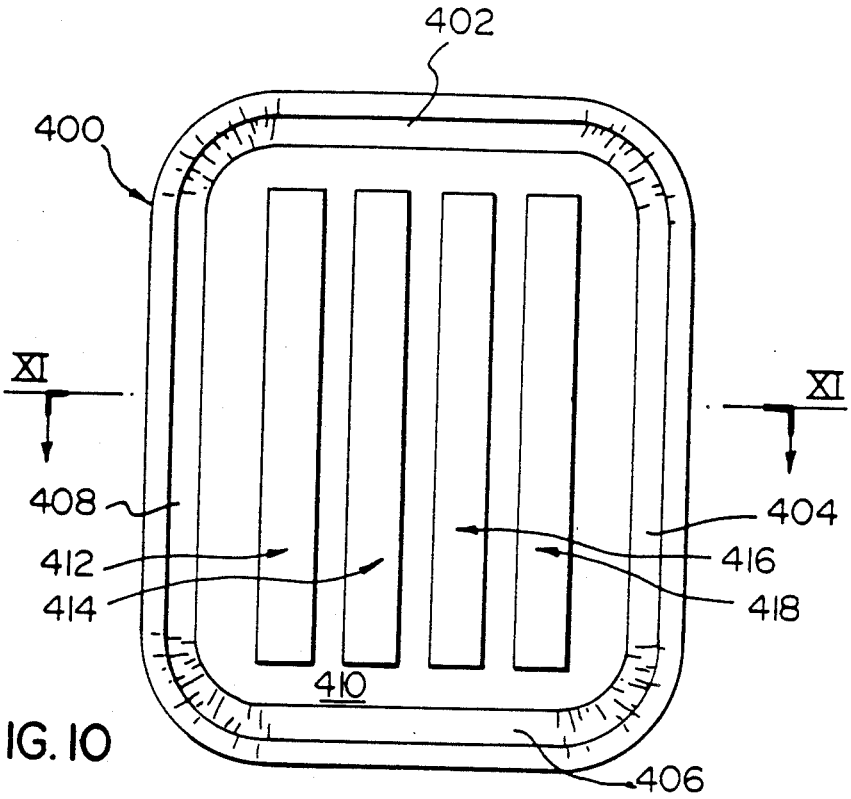
FIG. 10 is a top plan view of a container including yet another embodiment of the present invention.
Figure 11:
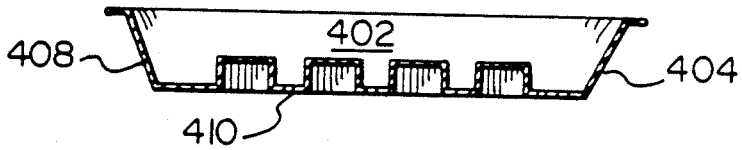
FIG. 11 is a sectional view of the container shown in FIG. 10 taken along line XI—XI of FIG. 10.

FIGS. 10 and 11 refer to yet another embodiment of the present invention used in conjunction with a rectangular container. Referring now to FIGS. 10 and 11, a rectangular container 400 includes sidewalls 402,404,406 and 408 and a bottom 410. Higher order mode generating structures 412,414,416 and 418 are symmetrically located within the container 400 and are affixed to the bottom surface of the container. Each higher order mode generating structure 412,414,416 and 418 constitutes a long rectangular structure longitudinally oriented within the container 400. The combination of structures 412,414,416 and 418 in conjunction with the sidewalls 402,404,406 and 408 of the pan 400 create higher order mode propagation in the lower region of pan 400. Such higher order modes cause an intensified heating of the lower portion of the pan 400. It should be noted that pan 400 is relatively shallow in comparison with the other pans and pan 400 is intended to represent a pan wherein the foodstuff could be a pastry product. The configuration of the present invention as set out in FIGS. 10 and 11, as described above, provide an intense heating of the lower surface of the pan thereby tending to more strongly cook the lower pastry surface which is adjacent the bottom 410 of the pan 400 and the higher order mode propagating elements 412,414,416 and 418.

Each higher order mode generating structure of this embodiment is typically $13\times1\times0.5$ cm in a pan 400 $15\times10\times1.5$ cm.

Figure 12:
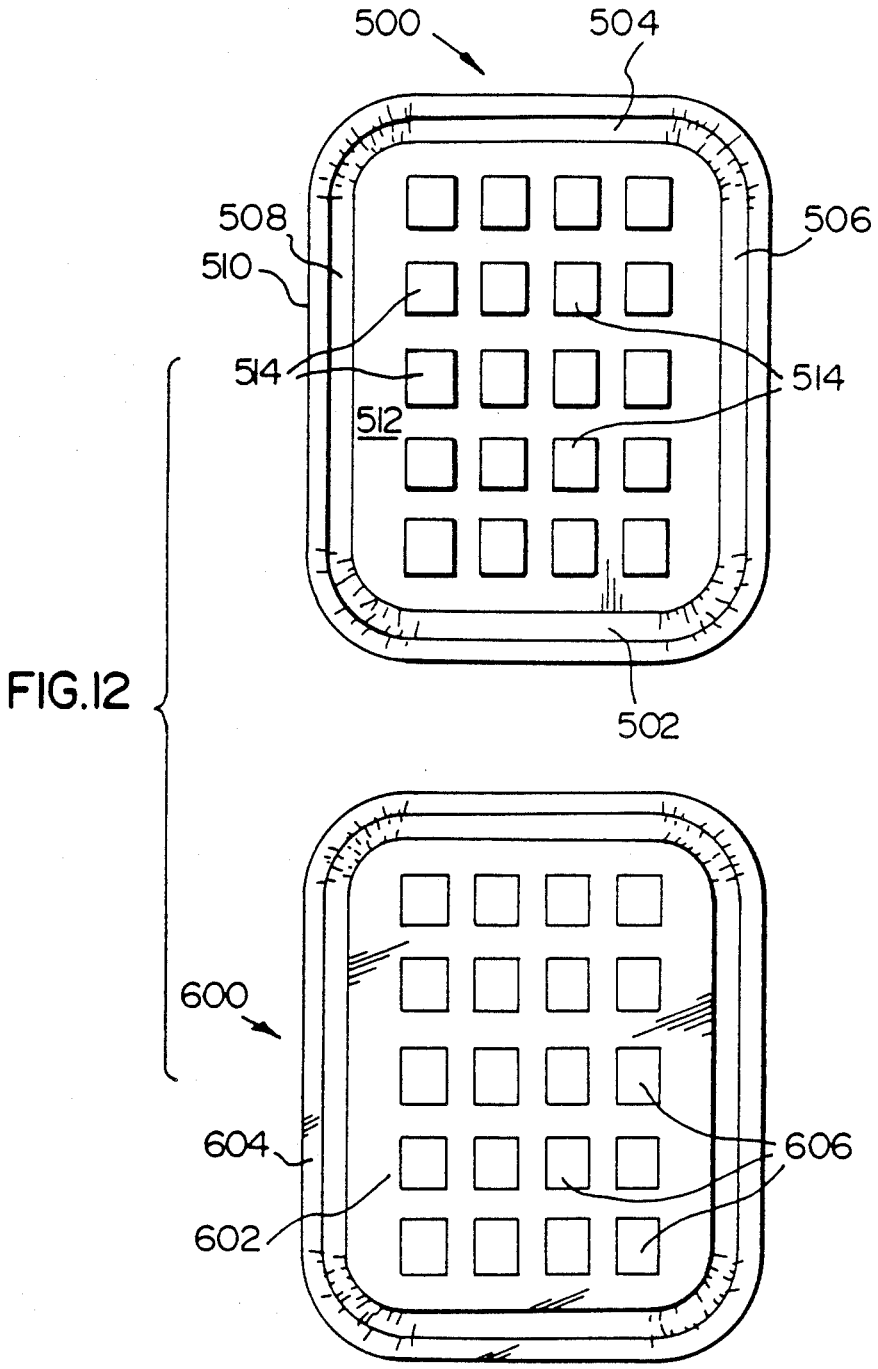
FIG. 12 is a plan view of yet another embodiment of the present invention.

FIG. 12 illustrates yet another embodiment of the present invention. A rectangular pan 500 includes sidewalls 502,504,506 and 508 and a surrounding lip 510. The container also includes a bottom 512 which has a symmetrical array of twenty multi-mode generating structures located thereon. Typical structures are identified by numeral 514. The structures 514 are arranged in an array of 5 rows of 4 structures each. In a pan which is $15\times10\times1.5$ cm, each structure 514 is approximately 1 cm square and from 0.5 to 0.8 cm high. Such a structure has been found to brown the lower surface of a foodstuff located thereon, for example, battered chicken or fish. The structure shown generates many regions of higher order modes concentrated at the bottom region of the pan. This action accounts for the high temperatures required for browning.

It has been found advantageous to use a special cover for such a container. The cover couples microwave energy into the pan 500 in an efficient manner which assists in achieving the high temperatures necessary for browning. Such a special cover is shown at 600 in FIG. 12. The cover is mde from a microwave-transparent material and has a flat top surface 602 joining a depressed rim 604 which can mate with lip 510 of pan 500. As a result, the top surface 602 is spaced above the top of container 500. Twenty metal islands typically shown at 606 on top surface 602. Metal islands 606 are conformal with the top surfaces of multi-mode structures 514. Such an array has been found to couple large amounts of microwave energy into the container 500 so that high browning temperatures can be achieved. It should be noted that cover 600 is not necessary for the use of pan 500. However, the efficiency of pan 500 is enhanced when used in conjunction with cover 600.

As was mentioned above, the preferred embodiment of the present invention employs metallic containers and metallic higher order mode generating structures. However, the present invention is not limited to metallic structures. As has been clearly set out above, boundary conditions exist between the foodstuff and free-space interfaces defined by transparent higher order mode generating structure located in microwave-transparent containers. Microwave-transparent containers used in conjunction with microwave-transparent higher order mode generators cause a more even distribution of the microwave energy within the foodstuff contained within the microwave-transparent structure and therefore create a more even heating of the foodstuff contained within the microwave-transparent structure. This embodiment describes in detail a container and lid which employs 20 multi-mode generating structures and associated metal islands. It should be noted that a container having any number of co-operating multi-mode generating structures and a cover having associated metal islands falls within the scope of this invention. In general there can be n multi-mode generating structures and associated metal islands.

Further embodiments of the invention are illustrated in FIGS. 13 to 18, each of which shows a modified fragment of the central lower part of FIG. 3 on a larger scale.

Figure 13:
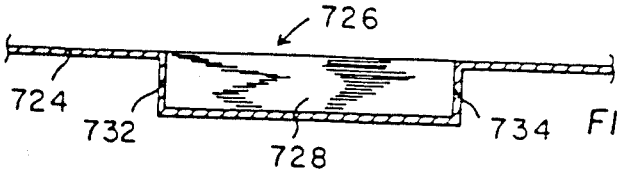
FIGS. 13 to 18 are diagrammatic side sectional views of part of the bottom surface of the container of FIG. 3 on an enlarged scale, showing further alternative embodiments.

In FIG. 13 a stepped or well type of structure 726 corresponds to the structure 26 of FIG. 3, except that it projects downwards from a planar bottom wall 724 of the container and hence away from the interior of the container. This downwardly projecting structure 726 also generates higher order mode oscillations and allows an enhanced heating effect at the central area of the container in a manner similar to that of the upwardly projecting structure 26 of FIG. 3, but for a somewhat different reason. The downwardly projecting structure 726 has sidewalls 728,732,734 and a fourth wall (not shown) corresponding to the wall 30 of FIG. 2, but, unlike the upwardly projecting structure 26 of FIG. 3, these sidewalls are not on the same vertical level as the sidewalls 14,16,18,20 of the container to cause higher order mode microwave energy to propagate in the regions 38 etc. On the other hand, the structure 726 itself forms a smaller scale subsidiary container with its own boundary conditions. Microwave energy that oscillates in this subsidiary container 726 at the fundamental mode for the boundary conditions of such subsidiary container, will constitute energy that is oscillating at a higher order mode than the fundamental mode for the main container.

The arrangement of FIG. 13 may have advantages over that of FIG. 3 for certain practical applications, such as situations in which the food or other material to be heated requires the container to have a flat inside bottom surface uninterrupted by any upward projection or projections. In addition, a well type structure, as shown at 726, affords better performance in terms of achieving a crisping or grilling of overlying food material.

Figure 14:
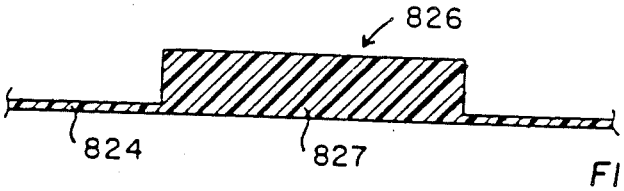

In FIG. 14, a stepped structure 826 follows the structure 26 of FIG. 3 in protruding into the container, but, in addition, it is filled with material 827. Although this filling material 827 can be different from the material of the bottom wall 824, it may be convenient to use the same material for both purposes, thus enabling the filling material and the bottom wall to be moulded as a unitary structure, in the manner shown.

The main advantage of such a "filled" structure 826, relative to the unfilled structure 26 of FIG. 3, is that it increases the local heating at the central area of the container for a given step height, or, conversely, enables the same local heating to be achieved with a lesser step height. This effect can be further enhanced by choosing as the filler a material having a dielectric constant greater than 10. For example, if the container and the filling material were to be formed integrally and made of glass or ordinary ceramics, the dielectric constant of such material would typically be in the region of 5 to 10.

If the practical advantages of moulding the entire container out of the same material are of dominant importance, and are combined with a desire for the filler material to have a dielectric constant somewhere in the range of 10 to 30, the entire container can be made out of a material having such a relatively high dielectric constant, that is a material that is non-standard as far as the usual manufacture of such containers is concerned.

Such a non-standard material might be a foam or a gel material container water; a ceramic material, including titanates; or a plastic or ceramic material impregnated with metal particles, e.g. polyethylene terephthalate impregnated with small particles of aluminium.

Alternatively, the container can be made of a standard plastic material, e.g. having a dielectric constant less than 10, while the filler material has a higher dielectric constant. The above-mentioned upper limit of 30 for the dielectric constant has been chosen somewhat arbitrarily, having been determined primarily by the fact that some materials with still higher dielectric constants tend to be more exotic and expensive. However, from the electrical point of view, materials with dielectric constants above 30 would be desirable, and such materials may prove economically viable, especially if the container is a utensil, i.e. a container that is designed to be reused many times, in contrast to a disposable, single-use article.

Figure 15:
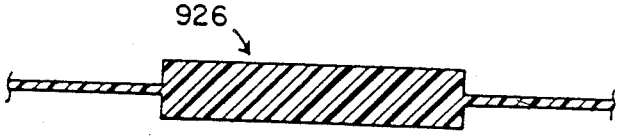

FIG. 15 shows a modification to this latter arrangement, wherein a stepped structure 926 is filled, while protruding both into and out of the container. The foregoing remarks in relation to FIGS. 13 and 14 apply equally to this embodiment, as far as its electrical performance and the choice of materials are concerned. FIG. 15 provides an example of an arrangement in which, by arranging for the filler material to project both upwards and downwards simultaneously, each projection can be kept relatively slight.

As a further alternative, the entire projection can be downwards, i.e. the combination of the "filled" structure concept with the fully downwardly projecting step of FIG. 13.

In the case of a filled FIG. 13 construction, the structure 726 may be filled with a foodstuff or other material to be heated in the container. Most foodstuffs have a dielectric constant approaching that of water, i.e. in the region of 80. Thus filling the downwardly projecting structure 726 with a material having a high dielectric constant will permit such structure to be relatively shallow for the same heating enhancement effect, in the same manner as the filling of the inwardly projecting structure 826 enables the step height to be less for a given heating effect.

Figure 16:
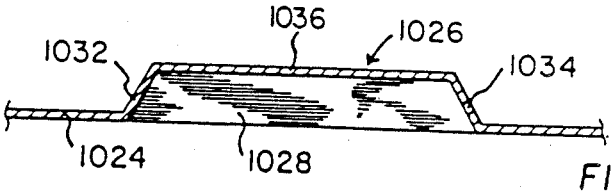

FIG. 16 shows a modification of FIG. 3 wherein a stepped structure 1026 has sidewalls 1028, 1032,1034 and a fourth wall (not shown) corresponding to the wall 30 of FIG. 2, that slope upwardly from a bottom wall 1024 to a top surface 1036, instead of having sidewalls that project perpendicularly relative to such bottom wall. This sloping arrangement simplifies manufacture of the container. Especially in the case of containers made of metal, it reduces breakage problems at the right angle corners required in the perpendicular arrangement of FIG. 3. FIG. 16 shows the sloping side walls 1032 etc., inclined at about 60° to the plane of the bottom wall 1024, but this angle can be increased or decreased as desired, including being reduced as much as to about 45°, while still achieving the desired electrical effect of acting as higher order mode generating means. However, a slope of less than about 45° would make the walls so gradual in their inclination, that the electrical performance would fall off appreciably. Therefore this angle of 45° can be taken as an arbitrary preferred lower limit, although lower angles (e.g. to 30° or even below) can be operable.

Figure 17:
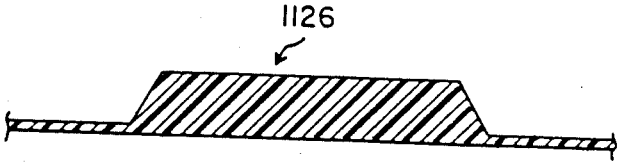

FIG. 17 shows a combination of FIGS. 14 and 16, combining the sloping wall feature with the use of filler material to form a stepped structure 1126. The doregoing remarks in relation to FIG. 14 apply equally to this embodiment, as far as its electrical performance and the choice of materials are concerned.

Figure 18:
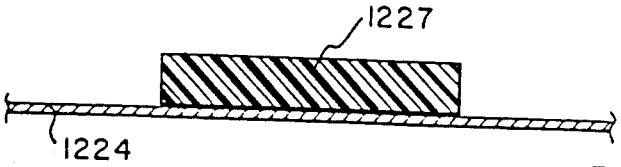

FIG. 18 shows a modification of FIG. 14 wherein the filling material 827 is replaced by a block 1227 that is formed separately from the bottom 1224 of the container and secured in place by suitable means e.g. glue, or even by the material in the container, assuming that the latter will be rigid, e.g. by freezing, and hence able to retain the block 1227 in the desired locations on the container bottom 1227 where it will constitute a "stepped structure" in the same manner as that of FIG. 14. This use of a separate block could also be used to provide a downwardly projecting stepped structure similar to a filled version of FIG. 13.

The changes to the shape and direction of the stepped structure, as exemplified by FIGS. 13 and 16, are applicable both to metal containers, i.e. reflective containers, and to non-reflective containers, e.g. those of plastic that are microwave-transparent or those of metallised plastic that are semi-microwave-transparent. On the other hand, the embodiments of FIGS. 14, 15, 17 and 18 involving filler material or the equivalent are applicable only to the non-reflective containers, because filler material placed in a cavity in a metallic (reflective) container would yield no appreciable desirable effect, even if such filler material had a relatively high dielectric constant.

While FIGS. 13–18 show modifications to a single stepped structure of the type shown in FIG. 3, it should be understood that these modifications are equally applicable to the alternative arrangements shown in FIGS. 5, 7, 9, 11 and 12.

The following observations have been made in practical tests:

(1) Use of low dielectric constant "filler" filling indented structures disclosed herein When a filler having a relatively low dielectric constant is placed within the indentations of a microwave-transparent or semi-microwave-transparent container, the container heating distributions are found to be similar to those that would be obtained without the use of a filler. When a filler of low dielectric constant (as might be obtained from a foamed or porous plastic) is used, the dimensions of the filled structure required for a particular desired heating distribution approach those of the unfilled structure.

As an example of a filled structure, a "styrofoam" filler, 12 mm thick, 7.5×3.3 cm cross-section, at the bottom of a polycarbonate (0.254 mm thick) microwave-transparent container, was compared with an unmodified polycarbonate container. The fill was "Cream of Wheet", made by Nabisco Brands, and prepared according to package directions. Because of its low density, styrofoam has a dielectric constant nearly that of air, the overall container bottom dimensions were approximately 13.5×9.0 cm. The heating interval was 45 sec. in a 700 Watt Sanyo Cuisine-Master test oven.

| | Unmodified Micro-Transparent | | | With Styrofoam Filler | | |
|---|---|---|---|---|---|---|
| WT (GM) | DC | DO-DC | DOA-DC | DC | DO-DC | DOA-DC |
| 220 | 9.0 | 22.5 | 15.3 | 19.0 | 12.5 | 8.3 |
| 260 | 9.5 | 20.5 | 15.9 | 10.8 | 18.0 | 14.6 |

-continued

| Unmodified Micro-Transparent | | | | With Styrofoam Filler | | |
|---|---|---|---|---|---|---|
| WT (GM) | DC | DO-DC | DOA-DC | DC | DO-DC | DOA-DC |
| 300 | 7.8 | 16.0 | 13.0 | 5.8 | 19.0 | 16.6 |
| 320 | 6.3 | 16.0 | 12.1 | 11.8 | 7.5 | 5.8 |
| 330 | 7.5 | 14.5 | 12.5 | 9.5 | 10.0 | 7.9 |
| 340 | 6.3 | 17.5 | 13.0 | 12.5 | 9.0 | 7.0 |
| 350 | 5.0 | 14.5 | 12.3 | 14.0 | 4.0 | 3.0 |
| 360 | 6.5 | 15.0 | 12.5 | 10.3 | 3.0 | 2.6 |
| 370 | 6.8 | 12.5 | 11.0 | 15.0 | 3.0 | 2.4 |
| 380 | 8.0 | 12.0 | 10.0 | 11.8 | 8.5 | 6.6 |
| 420 | 8.0 | 10.0 | 7.9 | 5.8 | 14.0 | 11.5 |

DC = Centre temperature-rise (C.)
DO = Max. outer temperature-rise (C.)
DOA = Average outer temperature-rise (C.), based on four points
WT (GM) = The weight in grams All thermal images of the heated fill in the unmodified, microwave-transparent container showed minimal heating in the central regions of the product, with heating concentrated at the container walls. By contrast, thermal images for the container with filler showed the emergence of a heated central region at low fill levels (at 220 gm, the filler was covered by a thin layer of fill) and at fills ranging from 320 to 380 gms.

(2) Filler in foil container

A filler located on the outside of a foil container is ineffective, because it is shielded by the container, depending on its thickness and other dimensions, a filler structure sized to promote the generation or propagation of higher order modes and placed at the inside bottom of a foil container can either increase or decrease heating at the central region of the container.

As an example of a structure providing increased central heating, a 5 mm thick styrofoam insert of 4.5×3.0 cm cross-section was placed at the centre inside bottom of a "Penny Plate" 7321 container, whose overall bottom dimensions were approximately 13.5×9.0 cm. The size of this insert corresponded to the dimensions of one "cell" of a (3,3) mode in the horizontal plane of the container. As above, the fill was "Cream of Wheat" and the fill weight was 340 gm. The same oven was used, and the heating interval was 60 sec.

| Unmodified Foil | | | Foil with Insert | | |
|---|---|---|---|---|---|
| DC | DO-DC | DOA-DC | DC | DO-DC | DOA-DC |
| 6.5 | 7.0 | 4.4 | 9.0 | 6.0 | 3.3 |

Thermal imaging of the samples showed that a more uniform heating distribution was obtained when an insert was used.

(3) The use of fillers having higher dielectric constants (A) To obtain fillers with higher dielectric constants, measured amounts of water were added to open-celled polyfoam samples. Because the dielectric constant of water is known for a variety of conditions, the dielectric constant of the water-polyfoam combinations could be estimated from a knowledge of the volume-fraction of water distributed in the polyfoam.

| Volume Fraction Water (Percent) | Estimated Dielectric Constant |
|---|---|
| 0.0 | 1.03 (Foam) |
| 5.7 | 5.0 |
| 8.6 | 7.0 |

-continued

| Volume Fraction Water (Percent) | Estimated Dielectric Constant |
|---|---|
| 10.1 | 8.0 |
| 13.0 | 10. |
| 15.9 | 12. |
| 20.2 | 15. |
| 27.5 | 20. |
| 34.8 | 25. |
| 41.9 | 30. |

(B) Higher dielectric constant structures extending beneath container

Improved or desired heating distributions may be obtained when higher dielectric constant structures are placed beneath microwave-transparent or semi-microwave-transparent container structures. To be effective in this regard, the higher dielectric constant structures should have cross-sectional dimensions (in the plane of the container bottom) that are such as to promote the generation or propagation of higher order modes within the container. The dielectric structure may be integral with, or part of the bottom of the container, when the structure has a high dielectric constant. However, it will preferably be separated from the bottom of the container by air or lower dielectric constant material when increased heating rates are desired at the central region of the container.

As an example of a higher dielectric constant structure beneath a container, a foam structure of 10 mm thickness and of cross-sectional dimensions 4.5×3.0 cm was impregnated with about 4.7 gm water, to give an estimated dielectric constant of 25. This structure was centred below a rectangular, polycarbonate container having dimensions of 13.5×9.0 cm, and as described above. The size of the dielectric structure corresponded to the dimension of one "cell" of a (3.3) mode in the horizontal plane of the container. The container fill was "Cream of Wheat" with a fill weight of 340 gm.

| Plain PC Container | | | With Structure Beneath | | |
|---|---|---|---|---|---|
| DC | DO-DC | DOA-DC | DC | DO-DC | DOA-DC |
| 4.0 | 21.0 | 16.3 | 13.5 | 7.5 | 4.4 |

In another example of a dielectric structure beneath a container, a foam structure of 10 mm thickness and having cross-sectional dimensions of 4.5×3.5 cm was impregnated with about 5.5 gm of water, to give an estimated dielectric constant of 25. The structure was positioned below the centre of a truncated oval polycarbonate container of similar shape to the 6018 foil container manufactured by Penny Plate, Inc. The size of the dielectric structure corresponded approximately to the dimensions of the centre "cell" of a (3,3) horizontal plane mode. The load consisted of 230 gm of "Cream of Wheat".

| Plain PC Container | | | With Structure Beneath | | |
|---|---|---|---|---|---|
| DC | DO-DC | DOA-DC | DC | DO-DC | DOA-DC |
| 6.5 | 21.5 | 18.1 | 14.0 | 11.0 | 8.8 |

Thermal imaging of the plain container showed a large, relatively cool central region, surrounded by warm regions near the walls of the container. By contrast, the container having an underlying dielectric structure showed the emergence of a warm region at the centre of the container.

(C) Higher dielectric structures extending into and from container bottom

When a higher dielectric constant structure extends into the container and from its bottom, improved or desired heating distributions may also be obtained. This structure may be integral with the container base, or may be placed in (and extend from) an indentation at the container base. When the structure has a high dielectric constant, its upper surface may be separated from the container (i.e. the lower surface of an indentation) by an air-gap is used, a layer of surface of microwave-transparent or semi-microwave-transparent material will provide support for the fill.

As an example of a structure extending to and from a container, a foam structure of 10 mm thickness and of cross-sectional dimensions 4.5×3.0 cm was loaded with about 4.7 gm of water, to obtain an estimated dielectric constant of 25. This structure was placed in a 5 mm deep indentation centred in the base of a container measuring 13.5×9.0 cm, so that it extended 5 mm from the plane of the container base. The cross-section of this structure and of the indentation corresponded to the dimensions of one "cell" of a (3.3) higher order container mode, so that the propagation or generation of higher order modes within the container was promoted. The container fill was 340 gm of the above-described "Cream of Wheat". As in the examples cited in section (B), the heating interval was 45 sec. in the same oven.

| | DC | DO-DC | DOA-DC |
|---|---|---|---|
| Structure extending from/into base | 13.5 | 6.0 | 3.9 |

In another example of a dielectric structure extending into and from a container, a foam structure of 10 mm thickness and having cross-sectional dimensions of 4.5×3.5 cm was loaded with about 5.5 gm of water, to give a dielectric constant estimated at 25. The structure was placed in a 5 mm deep, centred indentation, so that it extended 5 mm from the plane of the container bottom. The container was theremoformed from polycarbonate film in the shape of a Penny Plate 6018 foil container. As in the previous examples, the size of the dielectric structure and indentation were such as to promote the propagation or generation of higher order modes within the container and its fill.

| | DC | DO-DC | DOA-DC |
|---|---|---|---|
| Structure extending from/into base | 16.0 | 10.5 | 5.8 |

Thermal imaging of the loaded container and dielectric structure indicated pronounced heating at the centre of the fill, as well as at its periphery, in contrast with the unmodified container, which showed minimal heating at the container centre, with heating concentrated near the container walls.

(D) Dielectric structures "filling" and partially "filling" container indentations Improved or desired heating distributions may further be obtained when a dielectric structure fully protrudes into a container from its base, or when the dielectric structure projects into the container from an indentation at the base of the container. If the dielectric structure has a high dielectric constant, an air-gap or lower dielectric constant material is preferably interposed between the dielectric structure and the container fill. Especially when an air-gap is used, a layer or surface of microwave-transparent or semi-microwave-transparent material provides support for the fill in maintaining the air-gap. For a dielectric structure having a dielectric constant approaching that of the contained fill, minimal effect will be observed on the heating distributions within the fill (as arising from the dielectric structure) unless an interposing air-gap is used. This is because significant differences in dielectric properties are required at dielectric structure boundaries, in order for a dielectric structure to promote higher order mode propagation or generation within the container fill.

As an example of a dielectric structure fully protruding from a container base into the fill, thermoformed polycarbonate containers in the shape of Penny Plate 6018 foil containers were modified by the introduction of centred indentations. These indentations had cross-sectional dimensions of 4.5×3.5 cm (in the plane of the container bases), and protruded approximately 10 mm into the containers. Two sizes of dielectric structure were constructed from polyfoam (as above) and were impregnated with water to provide an estimated dielectric constant of 25. A 5 mm thick structure measured 4.5×3.5 cm in cross-section, and contained about 2.7 gm of water, and a 10 mm thick structure of the same cross-section contained about 5.5 gm of water. These structures were placed within the container indentations and were nearly flush against the upper surface of the indentations. 230 gm of "Cream of Wheat" fill was used as a load in these containers.

| | DC | DO-DC | DOA-DC |
|---|---|---|---|
| 5 mm thick structure in indentation | 15.5 | 9.5 | 7.5 |
| 10 mm thick structure in indentation | 16.0 | 10.0 | 6.5 |

Thermal images of both of the loaded, indented containers with dielectric structures showed warm regions at the centre and periphery of the fill. This represented an improvement in heating uniformity over the unmodified container.

(E) Note on the construction of containers having indented structures protruding from or placed beneath the container bottoms Particularly when a single protrusion or dielectric structure extends beneath a container, its cross-section to optimally provide higher order mode generation within the container will be substantially less than the overall base cross-sectional area. Since this may result in a tendency of the container to be mechanically unstable (i.e. to tip), it is desirable that supporting structures be provided. In the examples reported above in which the dielectric structures were placed or extended beneath the container, styrofoam supporting structures were placed beneath the edges of the containers to provide mechanical stability.

Some of the embodiments have been contemplated as being made from a semi-microwave-transparent material. This material would be especially suited for those embodiments used to brown a product. The $I^2R$ losses which such materials exhibit would provide a surface heating of the container which would aid browning.

All of the above embodiments can optionally employ a lid for the container.

I claim:

1. A package of material to be heated in a microwave oven, comprising a container and a body of material to be heated disposed in said container, said container including at least one sidewall and a bottom, said container and said body defining fundamental modes of microwave energy in said container, said container being provided with mode generating means for generating, within the container, at least one microwave energy mode of a higher order than that of said fundamental modes when said package is irradiated with microwave energy in a microwave oven, wherein the improvement comprises said mode generating means comprising at least one stepped structure protruding into said container from a surface thereof, said structure including at least one sidewall dimensioned and positioned with respect to the body of material in the container to define boundary conditions for causing microwave energy in said at least one higher order mode to propagate into the body of material to thereby locally heat the body of material.

2. A package as claimed in claim 1 wherein said at least one sidewall of said structure provides, in conjunction with said at least one sidewall of the container, boundary conditions that generate said at least one higher order mode.

3. A package as claimed in claim 1 wherein said stepped structure has portions respectively protruding into and outwardly from said container, the portion of said stepped structure that protrudes into the container including at least one sidewall that provides, in conjunction with said at least one sidewall of the container, boundary conditions that generate said at least one higher order mode, and the portion of said stepped structure that protrudes outwardly from said container forming a subsidiary container, said subsidiary container having at least one sidewall that provides boundary conditions that generate at least one microwave energy mode of a higher order than that of said fundamental modes.

4. A package as claimed in claim 1 wherein said structure comprises a substantially flat top portion surrounded and supported by a sidewall portion including said at least one sidewall of said structure.

5. A package as claimed in claim 1 wherein said at least one sidewall of the structure is oriented substantially at right angles to said surface.

6. A package as claimed in claim 1 wherein said structure is configured and positioned on said surface for generating or amplifying higher order modes which are harmonically related to said fundamental modes.

7. A package as claimed in claim 1 wherein said structure is configured and positioned on said surface for generating a mode which is of a higher order than that of said fundamental modes but is not harmonically related thereto.

8. A package as claimed in claim 1 wherein said structure is hollow.

9. A package as claimed in claim 1, said container comprising an open-topped tray for carrying said material, and wherein at least the tray portion of said container, and including said structure, is made of metallic material.

10. A package as claimed in claim 9 further comprising a lid covering said tray to form a cavity therewith.

11. A package as claimed in claims 1, said container comprising an open-topped tray for carrying said material, and wherein at least the tray portion of said container, and including said structure, is made of microwave transparent or semi-transparent material.

12. A package as claimed in claim 1 wherein the stepped structure protrudes from the bottom surface of the container.

13. A package as claimed in claim 12, wherein said body of material fills the container to a depth, and said stepped structure has a height, such that the ratio of the height of said stepped structure to the height of the fill depth of the material within the container is between 0.3 and 0.7.

14. A package of material to be heated in a microwave oven, comprising a container and a body of material to be heated disposed in said container, said container including at least one sidewall and a bottom, said container and said body defining fundamental modes of microwave energy in said container, said container being provided with mode generating means for generating, within the container, at least one microwave energy mode of a higher order than that of said fundamental modes when said package is irradiated with microwave energy in a microwave oven, wherein the improvement comprises said mode generating means comprising at least one stepped structure protruding out of said container from a surface thereof, said structure including at least one sidewall dimensioned and positioned with respect to the body of material in the container to define boundary conditions for causing microwave energy in said at least one higher order mode to propagate into the body of material to thereby locally heat the body of material.

15. A package as claimed in claim 14 wherein said stepped structure protrudes outwardly from said container thus forming a subsidiary container, and wherein said at least one sidewall of said structure provides boundary conditions that generate said at least one higher order mode.

* * * * *